United States Patent [19]

Joseph et al.

[11] Patent Number: 4,800,381

[45] Date of Patent: Jan. 24, 1989

[54] ELECTROMAGNETIC INDICATOR DEVICE

[76] Inventors: Johannes Joseph, Tulbeckstrasse 27, München 2; Maximilian Bleicher, Leonburgstrasse 11, München 90, both of Fed. Rep. of Germany, 8000; Walter Greiner, Tannenweg 8, Straubing, Fed. Rep. of Germany, 8440

[21] Appl. No.: 916,680

[22] PCT Filed: Jan. 21, 1986

[86] PCT No.: PCT/DE86/00018

§ 371 Date: Nov. 17, 1986

§ 102(e) Date: Nov. 17, 1986

[87] PCT Pub. No.: WO86/04440

PCT Pub. Date: Jul. 31, 1986

[51] Int. Cl.[4] ..... G09G 3/34

[52] U.S. Cl. ..... 340/764; 340/815.05

[58] Field of Search ..... 40/447, 466, 449, 450, 40/475, 473, 492; 340/763, 764, 783, 815.04–815.09, 815.23–815.24

[56] References Cited

U.S. PATENT DOCUMENTS

| | | | |
|---|---|---|---|
| 755,272 | 3/1904 | Burnham | 40/450 |
| 1,357,457 | 11/1920 | Jorgensen | 40/450 |
| 3,581,301 | 5/1971 | Stutz | 340/764 |
| 3,916,403 | 10/1975 | Mandszu et al. | 340/763 |
| 4,597,209 | 7/1986 | Hukill | 40/447 |

FOREIGN PATENT DOCUMENTS

| | | | |
|---|---|---|---|
| 0084959 | 8/1983 | European Pat. Off. . | |
| 1935678 | 1/1971 | Fed. Rep. of Germany . | |
| 2513550 | 10/1975 | Fed. Rep. of Germany . | |
| 346058 | 4/1931 | United Kingdom | 40/449 |

*Primary Examiner*—Marshall M. Curtis

*Attorney, Agent, or Firm*—Jacobson and Johnson

[57] ABSTRACT

An electromagnetic indicator device which has a plurality of triangle-shaped vanes, asymmetrical in relation to the rotation axis, which are arranged on a plate in the form of a matrix. A polarization magnet is applied to the vane in the vincinity of the rotation axis. The movement of the rotably supported vanes from a first position to a second position is effected, as appropriate, by a permanently associated electromagnet fixed behind the plate. A network of bearing brackets is fixed on the plate, whereby each four bearing brackets form the corner points of a square.

17 Claims, 4 Drawing Sheets

FIG. 6
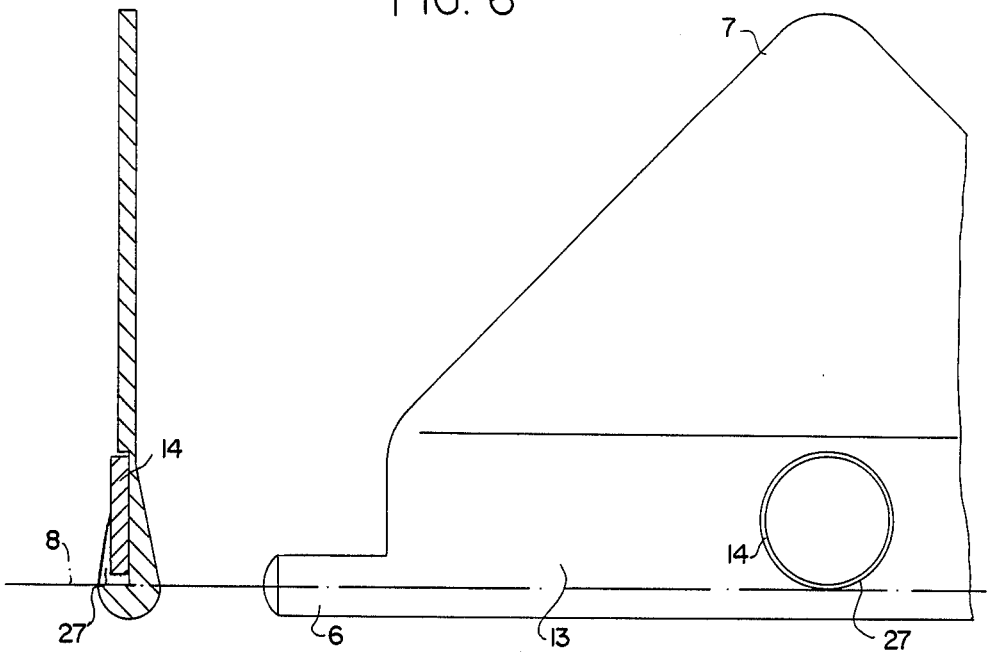
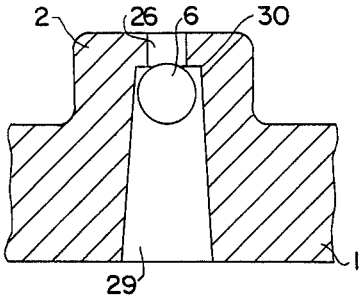
FIG. 7a
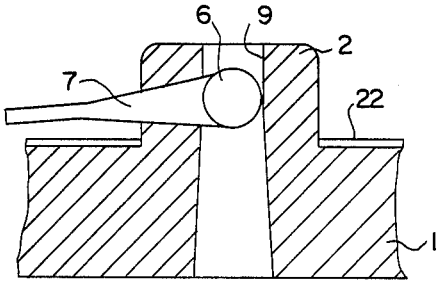
FIG. 7b

ELECTROMAGNETIC INDICATOR DEVICE

BACKGROUND OF THE INVENTION

The invention relates to an electromagnetic indicator device which has a plurality of triangle-shaped vanes asymmetrical in relation to the axis of rotation, which are arranged on a plate in the form of a matrix, whereby a polarizing magnet is applied to the vane in the vicinity of the axis of rotation and the movement of the rotably supported vanes from a first position to a second position is effected by a permanently associated electromagnet fixed behind the plate.

Such an indicator device is state of the art. In the European patent application Ser. No. 00 84 959 an indicator device is described having vanes being asymmetrical in relation to the axis of rotation and which are contollable for the covering and the release of an opening by means of an electromagnet. The vanes are provided with a permanent magnet in the vincinity of the axis of rotation.

Furthermore a device for the visual representation of characters is known which consists of indicators arranged in rows and columns in form of a matrix (German Auslegeschrift Ser. No. 19 35 678). The areas of the plate surface covered by the vane on both sides of the axis of rotation are colored matching the visual color of the vane. The vane is also formed asymmetrically in relation to the axis of rotation but the form of the vane is semicircular.

Because of their composition the known indicator devices are very difficult and expensive in manufacture, moreover such indicator devices can only be manufactured in certain minimum sizes, whereby the display surface of the vane must be in the order of more than one square centimeter.

SUMMARY OF THE INVENTION

An indicator device has to be specified having a more simple composition and renders possible a more economical manufacture, whereby also very small sizes are manufacturable.

This is achieved by a plate, which is provided on the surface with a network of bearing brackets aligned with the outer edges of the plate, whereby four bearing brackets each form the corner points of a square and each bearing bracket is provided with the bearing for the pin of one vane respectively with both bearings for the pins of two neighbouring vanes and the triangular vanes have the axis of rotation in the hypotenuse.

Because of the arrangement of the bearing brackets which are provided with the bearing for one pin respectively with the bearings for the pins of two neighbouring vanes in connection with the triangular form of the vanes a very compact construction of the indicator device is possible. Because of the triangular form of the vane the weight distribution is exceptionally convenient with respect to the axis of rotation, thus causing a greater turn-over speed and a greater stability in both final positions.

From the German patent application Ser. No. 25 13 550 a device for the representation of characters is known, whereby some display devices forming a row or column of a display matrix are arranged on a strip which is provided with supports in the form of the four corner points of a square. The supports act as bearings for the disk shaped turn-over plates. These turn-over plates are symmetrical and turn around themself from one display position to the other.

A further development of the invention is that the tip of the vane is provided with a curvature and the bearing brackets have a clearing on both sides.

By this means is achieved, that nearly the total triangular area, i.e. the half of the square can be used as display area. Furthermore a very compact construction and with that a good optical image resolution is achieved.

BRIEF DESCRIPTION OF THE DRAWINGS

FIG. 6 shows the top view and the side view of a vane and FIGS. 7*a* and 7*b* show two cuts through a bearing bracket.

DESCRIPTION OF THE PREFERRED EMBODIMENT

Figure 1:
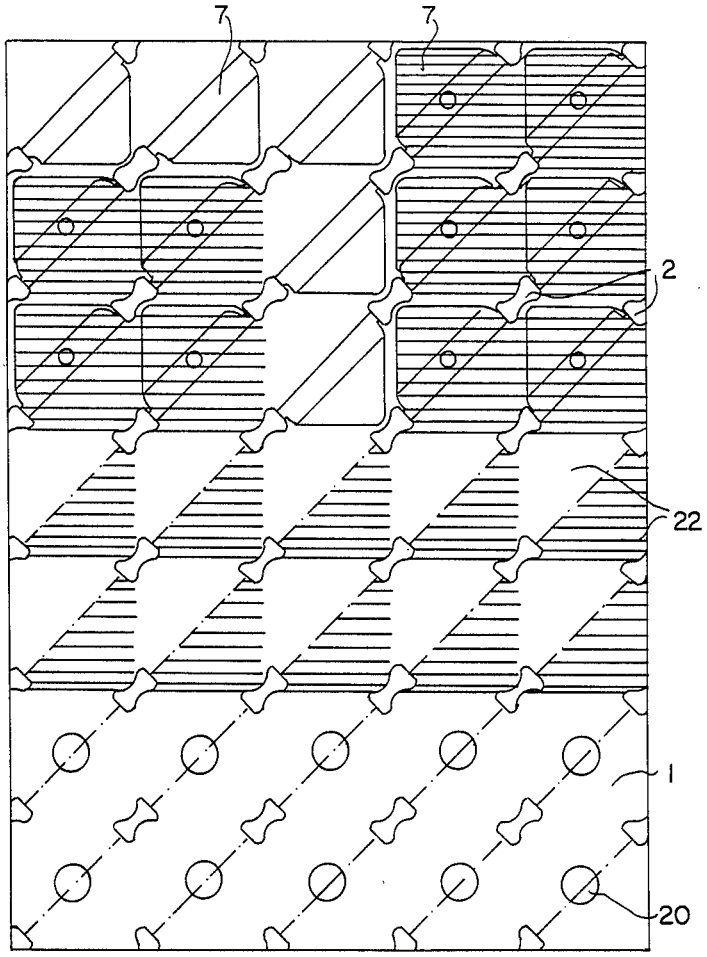
FIG. 1 shows the set-up of the indicator device in the top view in form of a mtrix.

The bearing brackets 2 are attached to the top side of plate 1 in such a manner that four each form the corner points of a square (FIG. 1). The bearing brackets 2 positioned along the edges of plate 1 each provide the bearing for one vane 7, whereas the rest of the bearing brackets 7 each provide both bearings for two neighbouring vanes. The plate 1 shows five columns with seven vanes each for the representation of letters, digits and characters. Electromagnets project through bore holes 20 in plate 1 as it is further described below. The bore holes 20 are covered by a foil 22 pasted on the top side of plate 1, the foil is printed such that within four bearing brackets 2 each a black and a white area is shown for example. The vanes 7 are also colored on one side with white and on the other side with black so that depending on the position of the vane either a black or a white area is shown within the bearing brackets 2 forming the corner points of a square. The edges of plate 1 are drawn to the bearing brackets 2 laying at the outside as far as that additional plates 1 can be joined together at each side in order to form a display area of any size whereby the distance between the vanes of two neighbouring plates 1 is equal as of two neighbouring vanes of one plate 1.

Figure 2:
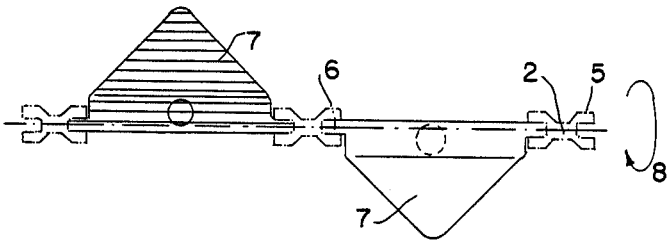
FIG. 2 shows both positions of a vane.

The vane 7 shown in FIG. 2 is provided with two pins 6 laying in the axis of rotation which are supported in the respective bearings 5 of two bearing brackets 2. A vane 7 turns around the axis of rotation 8 for 180° and is colored white on one and black on the other side. Obviously other color combinations are also possible.

Figure 3:
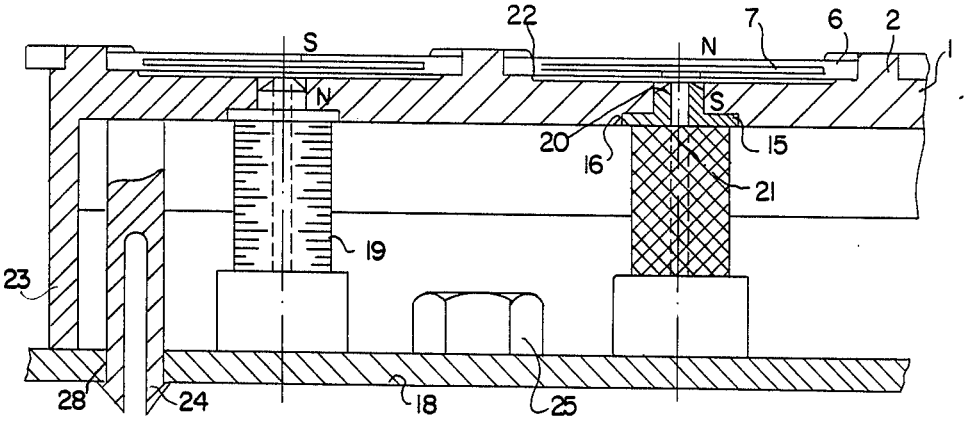
FIG. 3 shows the a cut through the indicator device in the side view.

The cut according to FIG. 3 shows the vanes 7 in both positions whereby the polarizing magnet as further described below lies with its north pole respectively with its south pole in the vicinity of the soft iron or remanent core 21 of the electromagnet 19. The activation of the vanes 7 is performed by the magnetic field of the electromagnet 19, whereby the direction of the magnetic field is caused by reversing the current in the electromagnet or by an additional winding. By use of a remanent core 21 of the electromagnet a shockproof position of the vanes 7 is enshured.

The electromagnets 19 are attached to a printed circuit board 18. Plate 1 is provided at the lower side with spreading nipples 24 and noses 23. Moreover plate 1 is provided with recesses 15 and bore holes 20 at its lower side. By a suitable forming of the coil body of the electromagnet 19 the coil body centers with its flange 16 in the recess 15 and eventually also in the bore hole 20. The printed circuit board 18 is provided with bore holes 28 in which the spreading nippels 24 snap in and press the printed circuit board 18 against the noses 23. Nuts 25 are attached to the side of the printed circuit board 18 carrying the electromagnets 19 for fastening the indicator device consisting of plate 1 and printed circuit board 18 to a not shown frame, whereby a plurality of indicator devices according to the invention can be attached to this frame which is not shown.

As already mentioned the core 21 in form of a pin of the electromagnet projects into the bore hole 20 closely to the upper side of plate 1, whereby the bore hole 20 is covered by the foil 22 attached to the upper side of plate 1.

Figure 5:
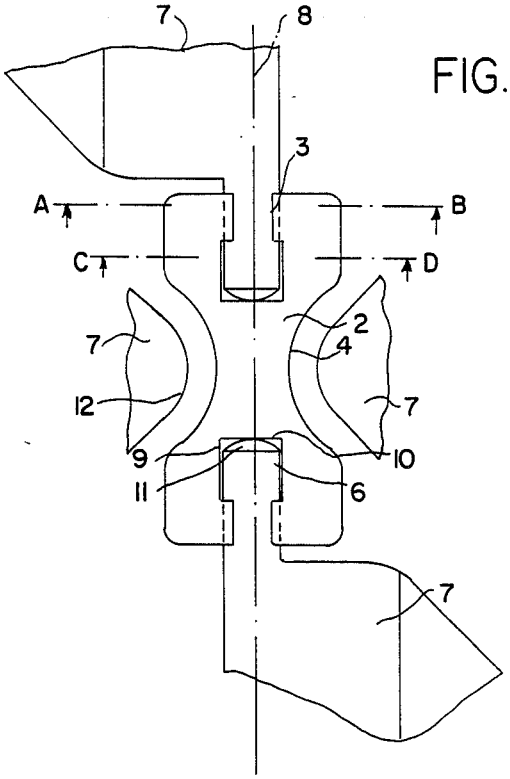
FIG. 5 shows the top view of a bearing bracket with the bearings of two neighbouring vanes.

The arrangement of a bearing bracket 2 is shown in FIG. 5. The vanes 7 are rounded at the tip 12 of their triangular area and the bearing bracket 2 is provided with a clearing 4 on both side which is formed in such a manner that the clearing 4 runs in parallel to the outer edge of the vane in the area of the tip 12. By this formation of vane 7 and bearing bracket 2 an especial compact embodiment i.e. an exceptional close arrangement of the vanes is possible. The bearing brackets 2 having only one bearing for pin 6 of a vane being situated at the edge of plate 1 (ref. to FIG. 1) are formed as one half of a bearing bracket having two bearing, but the clearing is continued in a straight line to the axis of rotation (this form would result automatically if the vane would have a real tip according to the triangle).

Figure 4A:
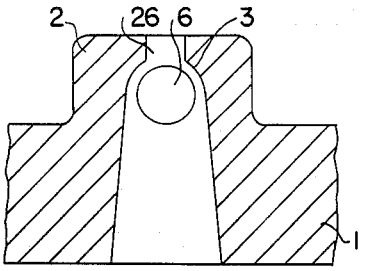
FIG. 4*a* and FIG. 4*b* show two cuts through a bearing bracket with two bearings.
Figure 4B:
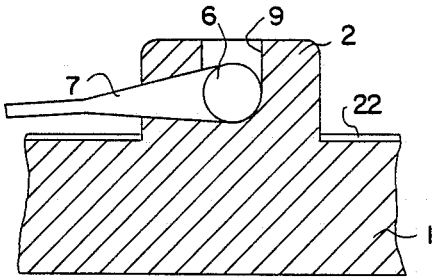

The pins 6 are supported in the radial direction by an upper bearing collar 3 and a lower bearing collar 9. The pins 6 have a rounded end 11 which lie against the bearing surface 10 of bearing bracket 2. Because of manufacturing reasons it is useful to divide up the radial support of pin 6 in two bearings being side by side. The formation of the bearing collars is illustrated by means of FIGS. 4*a* and 4*b*. The lower bearing collar 9 which is formed such that pins 6 does not lie on foil 22 is shaped by means of a die which is moved vertically away from the upper side of plate 1 after the injection process. The upper bearing collar 3 and the slit 26 which opens the latter in the direction of the axis of rotation is formed by two dies which are moved away from each other after the injection process. The touching point of both dies during the injection may be at an optional position within slit 26 but not near the upper bearing collar 3. The width of slit 26 is somewhat smaller than the diameter of pin 6 through which pin 6 can be pressed in order to be kept in its final position by the upper bearing collar 3 and the lower bearing collar 9. Plate 1 with all its attachment is suited to be manufactured by injection molding in one piece.

The vane 7 which is shown in an enlarged illustration according to FIG. 6 is provided with a rectangular part 13 in which the thickness tapers from the diameter of pin 6 to the thickness of the triangular area of vane 7. In the rectangular part 13 a recess 27 is provided which reaches exiguously over the axis of rotation 8 of vane 7. This recess 27 is used to accomodate the polarizing magnet 14, which is disk-shaped and has one pole on the upper and the other pole on the lower side. The polarizing magnet can be fixed on the vane by glueing. It is practical to color the side of the vane 7 carrying the polarizing magnet in black or dark in order to have the polarizing magnet as less as possible visible whilst the other side not having a recess 27 is colored in white or bright.

As already mentioned plate 1 can be manufactured completely by one injection molding process in thermoplastics. Just so the vanes 7 also can be manufactured by one injection molding process.

The upper bearing collar 3 according to FIG. 3 must not be absolutely semicircular but can be formed because of manufacturing reasons also angular. Hereby pin 6 of vane 7 is supported from above by means of the projections 30, which are formed by the slit 26 and by the recess 29 in plate 1 affected by the injection molding die (FIG. 7*a*). By this means the forming of burrs at the bearing can be avoided.

Furthermore the lower bearing collar can be abandoned (FIG. 7*b*) so that the pin 6 of vane 7 is only supported by the upper bearing collar 3 respectively by the projection 30 whereas the lower support of the pin 6 is performed by the upper side of plate 1 respectively by the foil 22 glued to the plate out of the bearing brackets 2. In this case the side of vane 7 opposite the tip must be rounded according to the pin 6.

What is claimed is:

1. An electromagnetic indicator device having a plurality of pivotable, triangle shaped vanes which are asymmetrical in relation to the axis of rotation, said vanes arranged on a plate in the form of a matrix, each vane having a polarization magnet attached in the vicinity of said axis of rotation and pivot pins at the ends of the axis of rotation, an electromagnet for each vane fixed behind said plate for pivotably moving the associated vane from a first position to a second position on said plate, the upper side of said plate being provided with a network of bearing brackets aligned with the outer edges of said plate such that a set of four of said bearing brackets form the corner points of a square and diagonally opposite bearing brackets in a square provide the support for the pivot pins of one of said vanes, the axis of rotation of said vanes being the hypotenuse of the triangular form of said vanes.

2. An electromagnetic indicator device as specified in claim 1, wherein the tip of said vane opposite the hypotenuse is rounded.

3. An electromagnetic indicator device as specified in claim 1 or 2 wherein said bearing brackets are provided with a clearance on both sides for the tip of said vanes.

4. An electromagnetic indicator device as specified in claim 1 wherein said support comprises an upper bearing collar and a lower bearing collar positioned side by side.

5. An electromagnetic indicator device as specified in claim 1, wherein said support is provided with a bearing surface for a rounded end of said pin.

6. An electromagnetic indicator device as specified in claim 1 wherein said vane has a thickness in the area of the axis of rotation which corresponds generally to the diameter of said pins.

7. An electromagnetic indicator device as specified in claim 1, wherein said vane is provided with a rectangular part between said pins which tapers from the diameter of said pins to the thickness of the triangular area.

8. An electromagnetic indicator device as specified in claim 7, wherein between the axis of rotation and the end of said rectangular part a recess is formed for receiving the polarization magnet.

9. An electromagnetic indicator device as specified in claim 1, wherein said plate is provided at its lower side with recesses for the mounting of flanges of the coil form of said electromagnets attached to a printed circuit board.

10. An electromagnetic indicator device as specified in claim 1, wherein said plate is provided with bore holes in which each of the cores of said electromagnets project closely to the upper side of said plate.

11. An electromagnetic indicator device as specified in claim 10, wherein said bore holes are covered by a foil glued to the upper side of said plate and said foil is provided with a triangular pattern on its upper side.

12. An electromagnetic indicator device as specified in claim 1, wherein said plate is provided with noses on its lower side on which rests a printed circuit board carrying said electromagnets.

13. An electromagnetic indicator device as specified in claim 12, wherein said plate is provided with spreading nipples on its lower side which project through corresponding bore holes in the printed circuit board to hold the latter pressed against said noses.

14. An electromagnetic indicator device as specified in claims 9, 12 or 13, wherein on the side carrying said electromagnets of said printed circuit board fastening means are attached.

15. An electromagnetic indicator device as specified in claim 8, wherein said polarization magnet is disk shaped and has one pole on the upper side and the other pole on the lower side.

16. Electromagnetic indicator device as specified in claim 4, wherein said upper bearing collar is provided with a slit in the direction of the axis of rotation which is slightly narrower than the diameter of said pin.

17. An electromagnetic indicator device as specified in claim 16, wherein said support is provided with a recess in the direction of the axis of rotation for the radial support of said pin and with two projections, whereby the projections are formed by said slit and by said recess.

* * * * *